US008677945B2

(12) United States Patent
Sumi et al.

(10) Patent No.: US 8,677,945 B2
(45) Date of Patent: Mar. 25, 2014

(54) BOILER

(75) Inventors: Soji Sumi, Matsuyama (JP); Yukihiro Tokunaga, Matsuyama (JP)

(73) Assignee: Miura Co., Ltd., Matsuyama-shi (JP)

( * ) Notice: Subject to any disclaimer, the term of this patent is extended or adjusted under 35 U.S.C. 154(b) by 596 days.

(21) Appl. No.: 12/997,362

(22) PCT Filed: Apr. 9, 2009

(86) PCT No.: PCT/JP2009/057240

§ 371 (c)(1),
(2), (4) Date: Dec. 10, 2010

(87) PCT Pub. No.: WO2009/150891

PCT Pub. Date: Dec. 17, 2009

(65) Prior Publication Data

US 2011/0088636 A1 Apr. 21, 2011

(30) Foreign Application Priority Data

Jun. 13, 2008 (JP) ..... 2008-155088

(51) Int. Cl.
*F22B 25/00* (2006.01)

(52) U.S. Cl.
USPC ..... 122/235.11; 122/235.15; 122/367.1

(58) Field of Classification Search
USPC ..... 122/18.1, 18.4, 32, 235.11, 235.15, 122/367.1, 367.2, 347, 360
See application file for complete search history.

(56) References Cited

U.S. PATENT DOCUMENTS

| | | | | |
|---|---|---|---|---|
| 4,825,813 | A * | 5/1989 | Yoshinari et al. | 122/6 A |
| 6,253,715 | B1 * | 7/2001 | Takubo et al. | 122/235.11 |
| 6,269,782 | B1 * | 8/2001 | Kayahara et al. | 122/235.11 |
| 6,318,305 | B1 * | 11/2001 | Takubo et al. | 122/235.11 |
| 7,827,941 | B2 * | 11/2010 | Sumi | 122/235.11 |
| 2008/0127910 | A1 * | 6/2008 | Sumi | 122/18.4 |

FOREIGN PATENT DOCUMENTS

| | | |
|---|---|---|
| CN | 101191662 A | 6/2008 |
| JP | 11-44401 | 2/1999 |
| JP | 2000-314502 | 11/2000 |
| JP | 2002-48302 | 2/2002 |
| JP | 3373127 | 2/2003 |

* cited by examiner

*Primary Examiner* — Gregory A Wilson
(74) *Attorney, Agent, or Firm* — Fox Rothschild LLP

(57) ABSTRACT

A boiler has an upper header, a lower header and a heat-transfer tube. The heat-transfer tube connects the upper header with the lower header. The hear-transfer tube is provided with projections such that a heat-transfer area per unit length of the heat-transfer tube is smaller in an upstream region than that in a downstream region of combustion gas.

5 Claims, 4 Drawing Sheets

BOILER

BACK GROUND OF THE INVENTION

1. Field of the Invention

The present invention relates to a various kinds of boilers including a steam boiler, a hot water boiler, a waste-heat boiler and an exhaust gas boiler. The present application is a 371 of International Application No. PCT/JP2009/057240 filed Apr. 9, 2009, which claims a priority right based on Japanese Patent Application No. 2008-155088 filed in Japan on Jun. 13, 2008, and the contents of which are incorporated herein by reference.

2. Description of the Related Art

As a multitubular boiler, one disclosed in Japanese Patent No. 3373127 is known. The boiler of this kind includes a can body provided between an annular upper header and an annular lower header, and the can body includes a large number of concentrically and cylindrically arranged water tubes. A portion in the can body located inward of an inner water tube row is a combustion chamber, and the portion of the can body located outward of the inner water tube row is a combustion gas passage.

Therefore, if fuel is burnt from a burner disposed on an upper portion of the can body toward the combustion chamber, the combustion gas is reversed at a lower portion in the combustion chamber, passes between the inner water tube row and an outer water tube row, and is discharged into a flue dust from the upper portion of the can body as exhaust gas. During this time, heat of the combustion gas and heat of water in the water tubes are exchanged, and the water in the water tubes is heated. To effectively transfer heat to the water in the water tubes, fins (11) are provided on each of outer water tubes at equal distances from one another in the vertical direction, and the heat-transfer area is increased.

However, the temperature of the combustion gas is lowered toward downstream. For example, in the case of a can body shown in FIG. 1 of Japanese Patent No. 3373127, combustion gas flows from a combustion chamber located inward of an inner water tube row, and flows upward in a combustion gas passage between an inner water tube row and an outer water tube row, and as the combustion gas flows upward in the combustion gas passage, a temperature of the combustion gas becomes lower. That is, a lower portion of the combustion gas passage is a high temperature portion as compared with an upper portion thereof.

Therefore, if fins are merely provided on each of the water tubes at equal distances from one another in the vertical direction without taking such circumstances into consideration, a thermal stress generated in the fins that are located near the combustion chamber is increased. Especially when scale adheres to the inside of the water tube, since heat-transfer from the fins to the water in the water tube is hindered, there is an adverse possibility that an excessive thermal stress is generated in the fins. In this case, the fins are excessively heated, and the fins may fall off or may be burnt. It is also necessary to take, into consideration, the pressure loss of combustion gas caused when the combustion gas enters the combustion gas passage from the combustion chamber. In view of these points, it can be conceived not to dispose fins in the high temperature portion as in the invention disclosed in Japanese Patent No. 3373127, but a case in which the high temperature portion is not utilized, this is not preferable in terms of the efficient heat recovery.

SUMMARY OF THE INVENTION

It is an object of the invention to moderate a thermal stress generated in the fins, to reduce a pressure loss of combustion gas, and to effectively recover heat.

The present invention has been accomplished to solve the problem, and a first aspect of the present invention is directed to a boiler wherein projections are provided on a heat-transfer tube which connects an upper header and a lower header with each other such that a heat-transfer area per unit length of the heat-transfer tube becomes smaller in an upstream region than that in a downstream region of combustion gas.

According to the first aspect of the present invention, enlargement of the heat-transfer area caused by the projections disposed on the peripheral side surface of the heat-transfer tube is set such that the enlargement becomes smaller in the upstream region (high temperature region) than that in the downstream region (low temperature region) of combustion gas. According to this, it is possible to moderate a thermal stress generated in the installing portions of the projections, to reduce a pressure loss of combustion gas, and to effectively recover heat.

A second aspect of the present invention is directed to the boiler according to the first aspect of the present invention, wherein installation pitches between adjacent upper and lower projections and/or projecting lengths of the projections from the heat-transfer-tube are changed such that the heat-transfer area per unit length of the heat-transfer tube becomes smaller in the upstream region than those in the downstream region of the combustion gas.

According to the second aspect of the present invention, the installation pitches of the projections are increased and/or the projecting lengths of the projections are reduced in the upstream region (high temperature region) as compared with the downstream region (low temperature region) of the combustion gas. According to this configuration, it is possible to moderate a thermal stress generated in the projections, to reduce a pressure loss of combustion gas, and to effectively recover heat.

A third aspect of the present invention is directed to the boiler according to the second aspect of the present invention, wherein the projecting lengths of the projections from the heat-transfer tube are set shorter in the upstream region than those in the downstream region of the combustion gas so as to reduce a difference of an amount of heat received per unit length of the heat-transfer tube that is created due to positions of the projections in a vertical direction of the heat-transfer tube, and in a case where the projecting lengths are the same, the installation pitches are larger in the upstream region than those in the downstream region of the combustion gas.

According to the third aspect of the present invention, the installation pitches of the projections are increased and/or the projecting lengths of the projections are reduced in the upstream region (high temperature region) as compared with the downstream region (low temperature region) of combustion gas. This configuration reduces a case where the amount of heat received per unit length of the heat-transfer tube is varied by a vertical position of the heat-transfer tube. According to this configuration, it is possible to moderate a thermal stress generated in the projections, to reduce a pressure loss of combustion gas, and to effectively recover heat.

A fourth aspect of the present invention is directed to the boiler according to the third or second aspect of the present invention, wherein the projections are fins provided on the heat-transfer tube at distances from one another in the vertical direction, the boiler further includes a plurality of inner heat-transfer tubes which are arranged cylindrically between the upper header and the lower header, and which constitute an inner heat-transfer tube row, a plurality of outer heat-transfer tubes which are arranged cylindrically between the upper header and the lower header to surround the inner heat-transfer tube row, and which constitute an outer heat-transfer tube row, a plurality of inner closing portions provided to close a gap between adjacent inner heat-transfer tubes while leaving a lower end of the inner heat-transfer tube row as it is, a plurality of outer closing portions provided to close a gap between adjacent outer heat-transfer tubes while leaving an upper end of the outer heat-transfer tube row, inner fins which extend outward from the inner heat-transfer tubes, respectively, on a surface constituting an outer peripheral surface of the inner heat-transfer tube row, and which are inclined upward in a circumferential direction of the inner heat-transfer tube row, and outer fins which extend outward from the outer heat-transfer tubes, respectively, on a surface constituting an inner peripheral surface of the outer heat-transfer tube row, and which are inclined upward in a circumferential direction of the outer heat-transfer tube row, and wherein projecting lengths of the inner fins and the outer fins from the heat-transfer tubes in a lower region of each of the heat-transfer tubes are set smaller than those in an upper region of each of the heat-transfer tubes, and in a case where the projecting lengths are the same, the installation pitches are larger in the lower region than those in the upper region of each of the heat-transfer tubes.

According to the fourth aspect of the present invention, it is possible to moderate a thermal stress generated in the fins, to reduce a pressure loss of combustion gas, and to effectively recover heat with a simple configuration.

A fifth aspect of the present invention is directed to the boiler according to the fourth aspect of the present invention, wherein an installing region of the inner fin in the inner heat-transfer tube and an installing region of the outer fin in the outer heat-transfer tubes are divided into a first region, a second region, a third region and a fourth region from bottom to top, projecting lengths of the inner fin and the outer fin in the first region and the second region are set smaller than those in the third region and the fourth region, and installation pitches of the inner fins and the outer fins in the first region and the third region are set larger than those in the second region and the fourth region.

According to the fifth aspect of the present invention, the boiler includes the first region having the relatively short fins with a large pitch, the second region having the fins with a fine pitch, the third region having the relatively long fins with a large pitch, and the fourth region having the fins with a fine pitch. According to this configuration, it is possible to moderate a thermal stress generated in the fins, to reduce a pressure loss of combustion gas, and to effectively recover heat.

According to the boiler of the present invention, it is possible to moderate a thermal stress generated in the fins, to reduce a pressure loss of combustion gas, and to effectively recover heat.

DETAILED DESCRIPTION OF THE PREFERRED EMBODIMENTS

Figure 1:
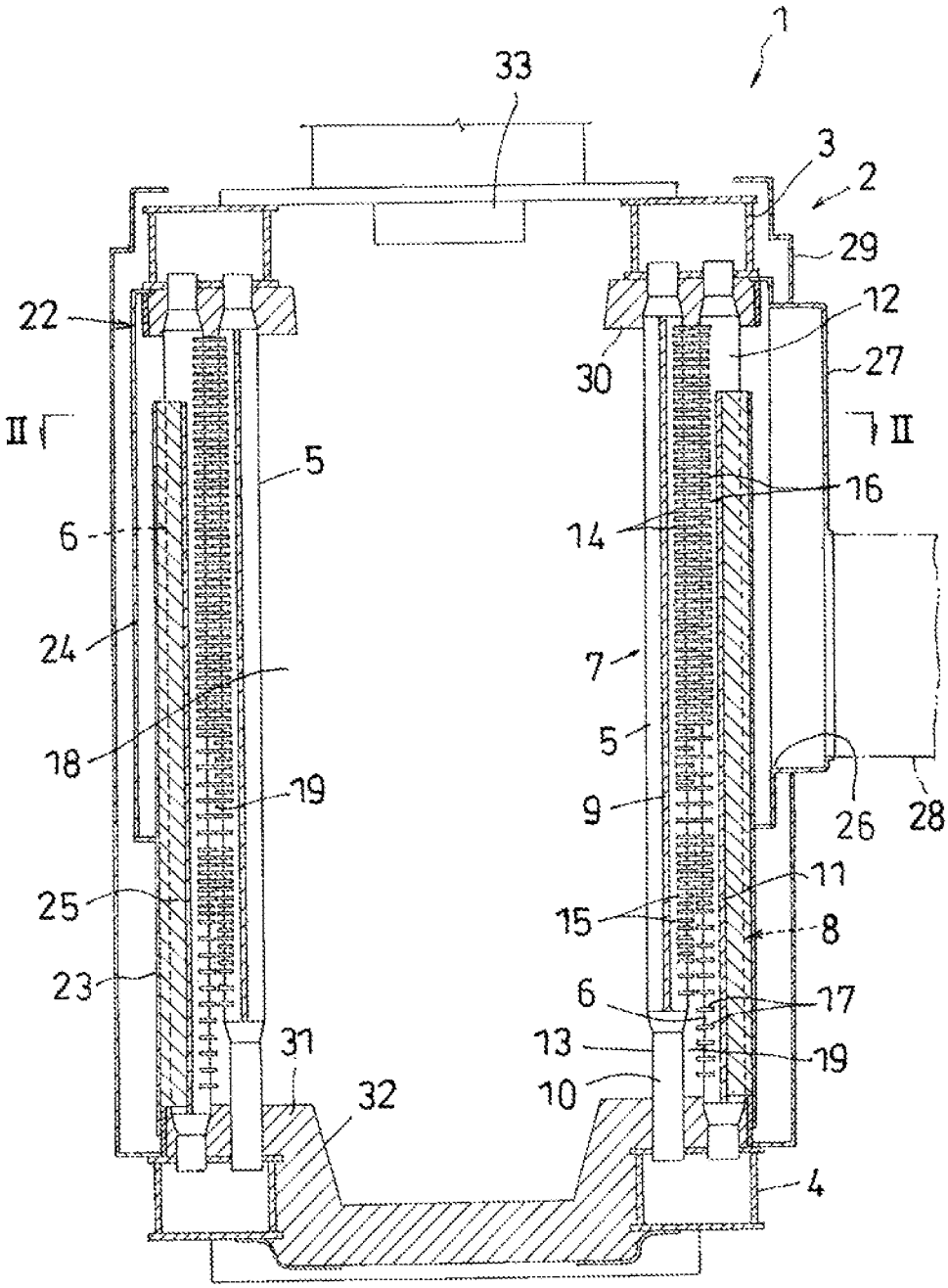
FIG. 1 is a schematic vertical sectional view showing an embodiment of a boiler of the present invention.
Figure 2:
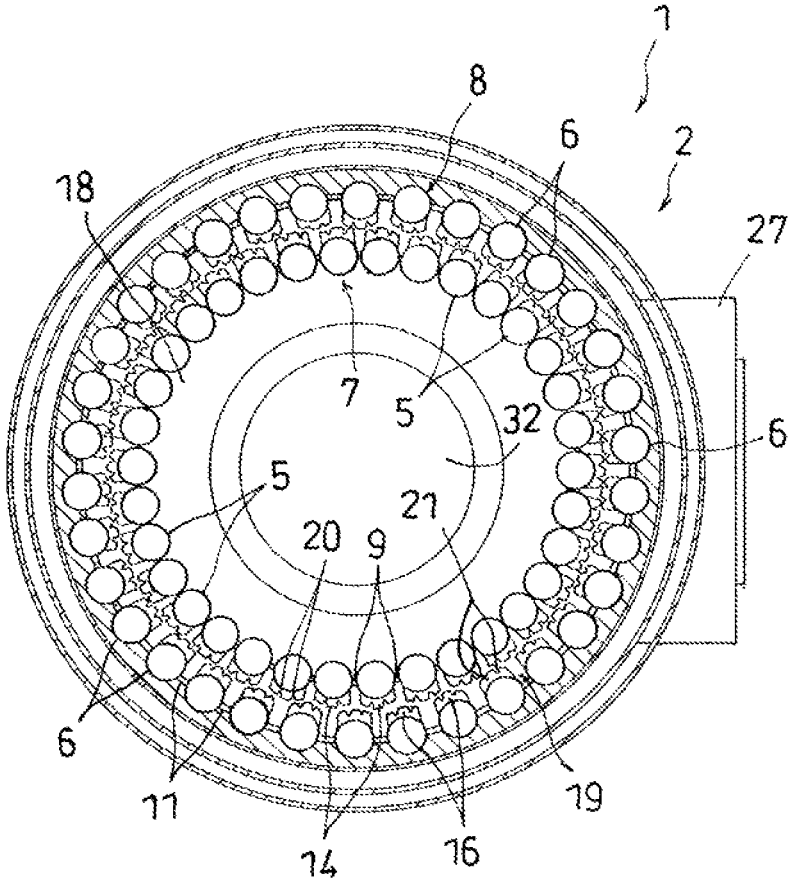
FIG. 2 is a sectional view taken along line II-II in FIG. 1.

A concrete embodiment of the present invention will be described below in detail based on the drawings. FIG. 1 is a schematic vertical sectional view showing an embodiment of a boiler of the present invention. FIG. 2 is a sectional view taken along line II-II in FIG. 1. The boiler 1 of the present embodiment is a multitubular once-through boiler including a cylindrical can body 2. The can body 2 is formed by connecting an upper header 3 and a lower header 4 through a large number of cylindrically arranged water tubes (heat-transfer tubes) 5 and 6.

The upper header 3 and the lower header 4 are disposed in parallel to each other such that they are separated from each other in the vertical direction, and they are hollow annular headers. The upper header 3 and the lower header 4 are disposed horizontally, and are disposed on the same axis.

The water tubes 5 and 6 are disposed vertically, upper ends thereof are connected to the upper header 3, and lower ends thereof are connected to the lower header 4. The water tubes 5 and 6 are sequentially arranged in a circumferential direction of the upper header 3 and the lower header 4, thereby forming cylindrical water tube rows 7 and 8. In this embodiment, the inner water tube row 7 and the outer water tube row 8 are arranged in forms of concentric cylinders. The inner water tube row 7 is formed from the cylindrically arranged inner water tubes 5. The outer water tube row 8 is formed from the cylindrically arranged outer water tubes 6 to surround the inner water tube row 7.

The inner water tubes 5 and the outer water tubes 6 are alternately arranged in the circumferential direction of the can body 2. That is, when viewing the can body 2 from above (FIG. 2), each of the outer water tubes 6 is disposed on a line which bisects an angle formed between by lines connecting, to each other, a common center of both the concentrically arranged water tube rows 7 and 8 and centers of inner water tubes 5 which are adjacent to that outer water tube 6.

Inner closing portions 9 are provided on the inner water tube row 7 such that gaps between respective adjacent inner water tubes 5 are closed while leaving lower end setting regions of the inner water tubes 5 as they are. That is, the gaps between the inner water tubes 5 are closed by the inner closing portion 9 except the lower end setting regions of the inner water tubes 5. At the lower end of the inner water tube row 7 that does not have the inner closing portions 9, gaps are formed between respective adjacent inner water tubes 5. These gaps form inner row communication portions 10, and the inside and the outside of the inner water tube row 7 are brought into communication with each other through the inner row communication portions 10.

Outer closing portions 11 are provided on the outer water tube row 8 such that gaps between respective adjacent outer water tubes 6 are closed while leaving upper end setting regions of the outer water tubes 6 as they are. That is, the gaps between the outer water tubes 6 are closed by the outer closing portion 11 except the upper end setting regions of the outer water tubes 6. At the upper end of the outer water tube row 8 that does not have the outer closing portions 11, gaps are formed between respective adjacent outer water tubes 6. These gaps form outer row communication portions 12, and the inside and the outside of the outer water tube row 8 are brought into communication with each other through the outer row communication portions 12.

In the illustrated example, each inner water tube 5 has a small diameter portion 13 formed at a position thereof corresponding to the inner row communication portion 10. That is, a lower end of each inner water tube 5 is formed into the small diameter portion 13 that is smaller in diameter than a portion of the inner water tube 5 located higher than the lower end. This design is for reducing a pressure loss caused when combustion gas enters a combustion gas passage 19 formed between the inner and outer water tube rows 7 and 8 through the inner row communication portion 10. Although the small diameter portion 13 is not formed on an upper end of each outer water tube 6 in the illustrated example, the small diameter portion may be formed like the inner water tube 5.

Figure 3:
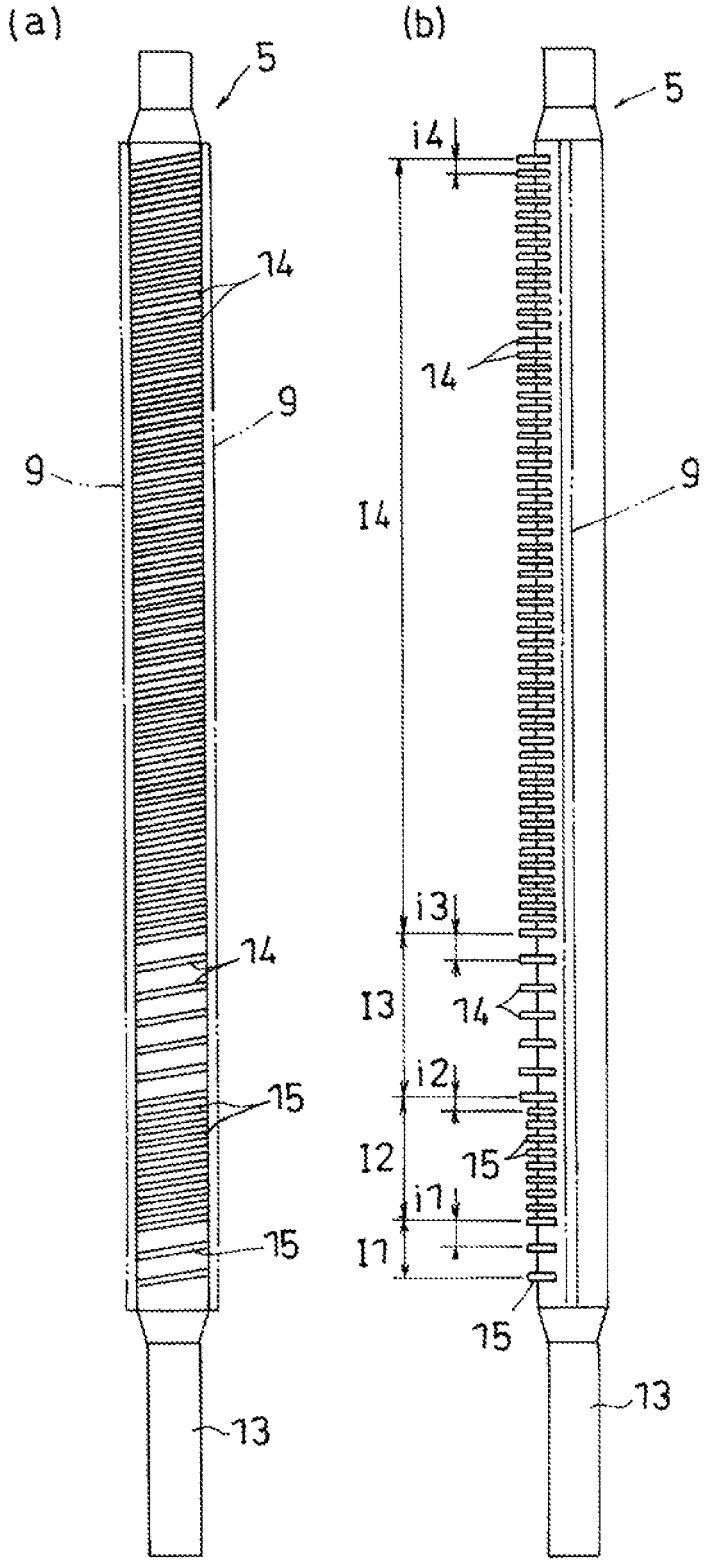
FIG. 3A is a diagram showing inner water tube of the boiler, as viewed from an outer periphery of an inner water tube row of the boiler shown in FIG. 1.
FIG. 3B is a diagram showing inner water tube of the boiler, and is a side view of an inner water tube row of the boiler shown in FIG. 1.
Figure 4:
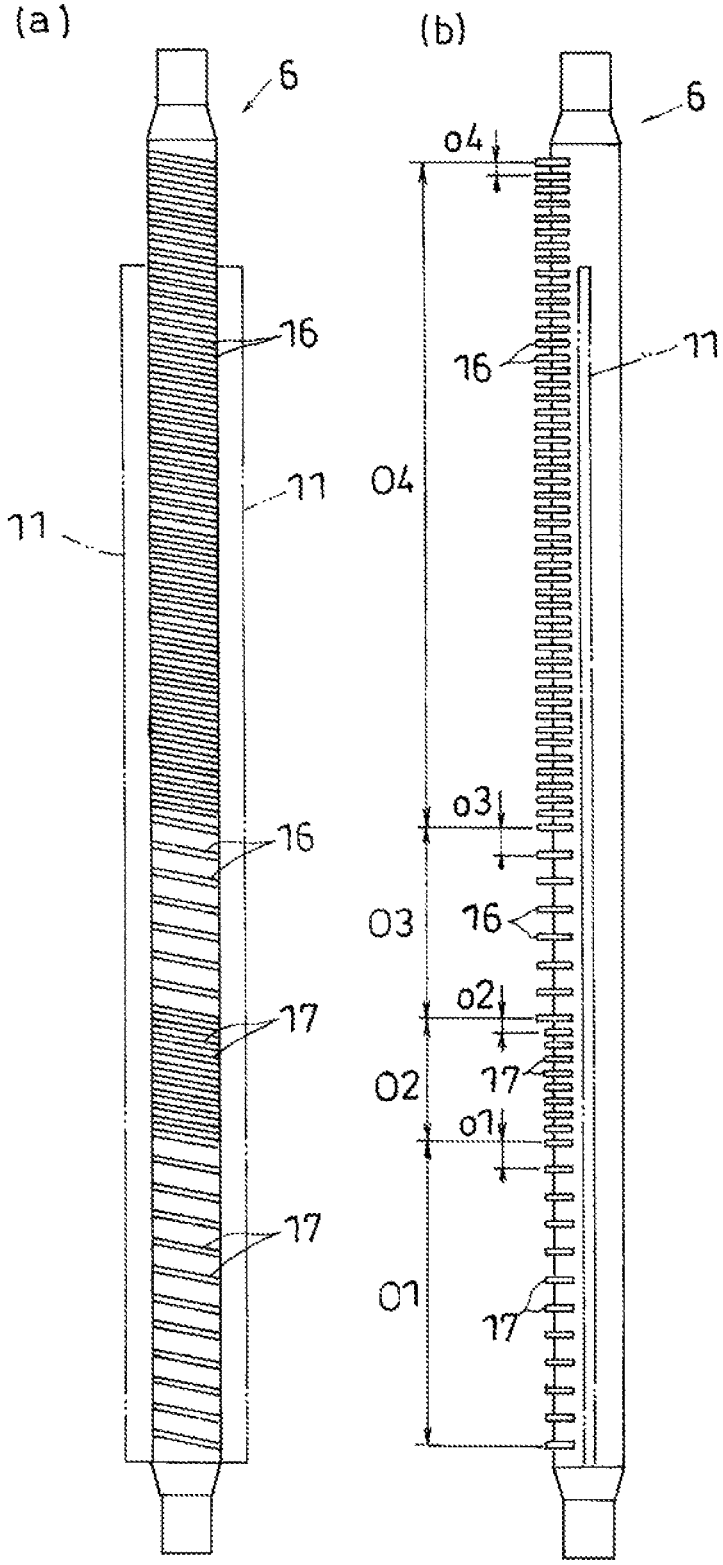
FIG. 4A is diagram showing outer water tube of the boiler shown in FIG. 1, as viewed from an inner periphery of an outer water tube raw.
FIG. 4B is a diagram showing outer water tube of the boiler shown in FIG. 1, and is a side view of an outer water tube row.

FIG. 3A is a diagram showing inner water tube 5 of the boiler, as viewed from an outer periphery of an inner water tube row 7, and FIG. 3B is a diagram showing inner water tube 5 of the boiler, and is a side view of an inner water tube row 7 of the boiler; and FIG. 4A is a diagram showing outer water tube 6 of the boiler, as viewed from an inner periphery of an outer water tube raw 8, and FIG. 4B is a diagram showing outer water tube 6 of the boiler, and is a side view of an outer water tube raw 8.

Projections as expanded heat-transfer surfaces are respectively provided on the water tubes 5 and 6. In this embodiment, these projections are fins 14, 15, 16 and 17. The fins 14 to 17 are provided such that heat-transfer areas per unit lengths of the water tubes 5 and 6 become smaller in an upstream region of the combustion gas than those in a downstream region thereof. In this embodiment, combustion gas from the combustion chamber 18 inside the inner water tube row 7 flows into the combustion gas passage 19 between the inner water tube row 7 and the outer water tube row 8 through the inner row communication portion 10 and flows upward. Therefore, upper regions of the water tubes 5 and 6 are the downstream regions of combustion gas, and lower region of the water tubes 5 and 6 are the upstream regions of combustion gas. Therefore, in this embodiment, the fins 14 to 17 are provided such that the heat-transfer areas per unit lengths of the water tubes 5 and 6 become smaller in the lower regions than those in the upper regions of the water tubes 5 and 6.

More specifically, the fins 14 to 17 are disposed such that installation pitches between adjacent vertical fins and/or projecting lengths from the water tubes 5 and 6 are changed. Typically, the projecting lengths of the fins 14 to 17 from the water tubes 5 and 6 are set shorter in the lower regions of the water tubes 5 and 6 than those in the upper regions thereof so as to reduce a difference of amounts of heat received per unit length of the water tubes 5 and 6 created due to positions of the water tubes 5 and 6 in the vertical direction, and in a case where the projecting lengths are the same, the installation pitches are larger in the lower region than those in the upper regions of the water tubes 5 and 6.

More specifically, the inner fins 14 and 15 are provided on a surface of the inner water tube 5 constituting the outer peripheral surface of the inner water tube row 7. The inner fins 14 and 15 extend radially outward of the inner water tube 5 in forms of flanges. At that time, the inner fins 14 and 15 are disposed on the inner water tube 5 at distances from one another in the vertical direction, but the inner fins 14 and 15 are not disposed on the lower end small diameter portion 13. The upper inner fins 14 are provided on the upper region of the inner water tube 5, and the lower inner fins 15 are provided on the lower region of the inner water tube 5. A projecting length of the lower inner fin 15 from the inner water tube 5 is shorter than that of the upper inner fin 14. As shown in FIG. 2, notches 20 are formed in an extending tip end of the upper inner fin 14, but no notch is formed in the lower inner fin 15.

The outer fins 16 and 17 are provided on surfaces of the outer water tubes 6 constituting an inner peripheral surface of the outer water tube row 8. The outer fins 16 and 17 extend radially outward of the outer water tube 6 in forms of flanges. At that time, the outer fins 16 and 17 are disposed in substantially the entire regions of the outer water tubes 6 in the vertical direction at distances from one another in the vertical direction. The upper outer fins 16 are formed on the upper region of the outer water tube 6, and the lower outer fins 17 are formed in the lower region of the outer water tube 6. The projecting length of the lower outer fin 17 from the outer water tube 6 is shorter than that of the upper outer fin 16. As shown in FIG. 2, notches 21 are formed in an extending tip end of the upper outer fin 16, but no notch is formed in the lower outer fin 17.

As described above, the inner water tubes 5 and the outer water tubes 6 are alternately disposed in the circumferential direction of the can body 2. Sizes, shapes and positions of the inner fins 14 and 15 and the outer fins 16 and 17 are adjusted such that they are not superposed on each other when viewing the can body 2 from above. The inner fins 14 and 15 and the outer fins 16 and 17 may be disposed horizontally, but they are preferably inclined upward toward one circumferential direction of the can body 2. In this embodiment, the inner fins 14 and 15 and the outer fins 16 and 17 are inclined the same set angle with respect to the axial direction (vertical direction) of the water tubes 5 and 6. This inclination angle is set to 80° for example. When the fins 14 to 17 are inclined from the horizontal state in this manner, combustion gas flowing upward in the combustion gas passage 19 between the inner water tube row 7 and the outer water tube row 8 is stirred, and the heat-transfer performance from the combustion gas to the water tubes 5 and 6 can be enhanced.

An installing region of the inner fins 14 and 15 in the inner water tube 5 is divided into a first region I1, a second region I2, a third region I3 and a fourth region I4 from bottom to up with respect to the inner water tube 5. The lower inner fins 15 are provided in the first region I1 and the second region I2, and upper inner fins 14 are provided in the third region I3 and the fourth region I4.

A difference between the first region I1 and the second region I2 is the installation pitch between the vertically adjacent lower inner fins 15. A pitch i1 in the first region I1 is wider than a pitch i2 in the second region I2. Similarly, a difference between the third region I3 and the fourth region I4 is the installation pitch between the vertically adjacent upper inner fins 14. A pitch i3 in the third region I3 is wider than a pitch i4 in the fourth region I4. In this embodiment, the installation pitches i1 and i3 of the fins 15 and 14 in the first region I1 and the third region I3 are equal to each other, and the installation pitches i2 and i4 of the fins 15 and 14 in the second region I2 and the fourth region I4 are equal to each other.

Similarly, an installing region of the outer fins 16 and 17 in the outer water tube 6 is divided into a first region O1, a second region O2, a third region O3 and a fourth region O4 from bottom to up with respect to the outer water tube 6. The lower outer fins 17 are provided in the first region O1 and the second region O2, and the upper outer fins 16 are provided in the third region O3 and the fourth region O4.

A difference between the first region O1 and the second region O2 is the installation pitch between the vertically adjacent lower outer fins 17. A pitch of in the first region O1 is wider than a pitch o2 in the second region O2. Similarly, a difference between the third region O3 and the fourth region O4 is the installation pitch between the vertically adjacent upper outer fins 16. A pitch o3 in the third region O3 is wider than a pitch o4 in the fourth region O4. In this embodiment, the installation pitches o1 and o3 of the fins 17 and 16 in the first region O1 and the third region O3 are equal to each other, and the installation pitches o2 and o4 of the fins 17 and 16 in the second region O2 and the fourth region O4 are equal to each other.

The regions I1 to I4 of the inner water tube 5 and the regions O1 to O4 of the outer water tube 6 are deviated from each other in the vertical direction. This is because that the inner peripheral surface of the inner water tube row 7 becomes the combustion chamber 18, but the outer peripheral surface of the outer water tube row 8 does not function as the heat-transfer surface as will be described later. Further, since the inner water tube 5 includes the small diameter portion 13, the regions I1 to I4 of the inner water tube 5 and the regions O1 to O4 of the outer water tube 6 are deviated from each other in the vertical direction. In this embodiment, the first region O1, the second region O2, the third region O3 and the fourth region O4 of the outer water tube 6, and the second region I2, the third region I3 and the fourth region I4 of the inner water tube 5 are alternately disposed. More specifically, the first region O1 of the outer water tube 6, the first region I1 of the inner water tube 5, the second region I2 of the inner water tube 5, the second region O2 of the outer water tube 6, the third region 13 of the inner water tube 5, the third region O3 of the outer water tube 6, the fourth region I4 of the inner water tube 5, and the fourth region O4 of the outer water tube 6 appear in this order from bottom to top of the can body 2.

Ranges of the regions I1 to I4 of the inner water tube 5, and the regions O1 to O4 of the outer water tube 6 are appropriately set. At that time, the amount of heat received per unit length of each of the water tubes 5 and 6 is set such that a difference of the amount of heat received caused due to positions of the water tubes 5 and 6 in the vertical direction is reduced. Preferably, the regions are further divided (regions are divided in a multistage manner) so that the amounts of heat received per unit lengths of the water tubes 5 and 6 are equalized over the entire place. In other words, this means that heat flux of the fins 14 to 17 (amount of heat received per unit heat-transfer area) are equalized.

A stepped cylindrical can body cover 22 is provided between the upper header 3 and the lower header 4 to surround the outer water tube row 8. The can body cover 22 includes an inner cylinder 23 and an outer cylinder 24 having a greater diameter than that of the inner cylinder 23. A lower end of the inner cylinder 23 is fixed to the lower header 4, and an upper end of the inner cylinder 23 is disposed at a height corresponding to a lower end of the outer row communication portion 12. An upper end of the outer cylinder 24 is fixed to the upper header 3, and a lower end of the outer cylinder 24 is disposed at a height corresponding to an intermediate portion of the inner cylinder 23 in the vertical direction. In this manner, the can body cover 22 seals a gap between the lower header 4 and the lower end of the inner cylinder 23, and seals a gap between the upper header 3 and the upper end of the outer cylinder 24. In the lower end of the outer cylinder 24, a gap between the inner cylinder 23 and the outer cylinder 24 is sealed. A heat insulator 25 is charged into a cylindrical gap between the outer water tube row 8 and the inner cylinder 23 of the can body cover 22.

A substantially rectangular opening 26 is formed in a portion of the outer cylinder 24 of the can body cover 22 in the circumferential direction. A swelling duct 27 is provided on the outer cylinder 24 of the can body cover 22 to cover the opening 26. The swelling duct 27 is a substantially rectangular hollow box, swells radially outward from the outer cylinder 24, and extends in the vertical direction. A flue dust 28 is connected to a lower end of the swelling duct 27. A cylindrical casing 29 is provided to surround the can body cover 22. The swelling duct 27 and the flue dust 28 penetrate the casing 29. A heat insulator (not shown) may be charged into a gap between the can body cover 22 and the casing 29.

Refractory materials 30 and 31 are provided on a lower surface of the upper header 3 and an upper surface of the lower header 4 to cover connected portions between the header 3 and the water tubes 5 and 6, and connected portion between the header 4 and the water tubes 5 and 6. At that time, the refractory material 31 on the side of the lower header 4 closes a central portion of the lower header 4. A columnar or circular truncated recess 32 is formed in the central portion of the refractory material 31 on the side of the lower header 4.

A burner 33 directed downward is provided on a central portion of the upper header 3. Fuel is supplied to the burner 33, and air used for combustion is also supplied to the burner 33. By operating the burner 33, fuel is burnt in the can body 2. At that time, the inner side of the inner water tube row 7 functions as the combustion chamber 18.

Combustion gas generated by combustion of fuel in the combustion chamber 18 is discharged into the combustion gas passage 19 between the inner water tube row 7 and the outer water tube row 8 through the inner row communication portion 10. The combustion gas flows upward in the combustion gas passage 19, the combustion gas is discharged radially from the upper portion of the outer water tube row 8, and is received in the can body cover 22. Thereafter, the combustion gas is discharged outside as exhaust gas through the swelling duct 27 and the flue dust 28 provided in the can body cover 22. During this time, heat of the combustion gas and heat of water in the water tubes 5 and 6 are exchanged to heat the water in the water tubes 5 and 6. According to this, steam can be taken out from the upper header 3. The steam is sent to a device which utilizes the steam (not shown) through a water separator (not shown) or the like.

According to the boiler 1 of the embodiment, the installation pitch of the fins is increased or the projecting length of the fin is reduced in the upstream region (high temperature region) as compared with the downstream region (low temperature region) of the combustion gas. This configuration reduces a case where the amount of heat received per unit length of the water tubes 5 and 6 is varied by a vertical position of the water tubes 5 and 6. According to this, thermal stress generated in the fins 14 to 17 can be moderated. Further, a pressure loss generated when combustion gas enters the combustion gas passage 19 from the combustion chamber 18 can be reduced. Further, since the fins 15 and 17 can be disposed also at the lower portion of the combustion gas passage 19 between the inner water tube row 7 and the outer water tube row 8, heat can be recovered at the high temperature portion, and efficiency can be enhanced.

The boiler of the present invention is not limited to the above described configuration and can appropriately be changed. Especially the configuration of the can body 2 can appropriately be changed. Although the example in which the invention is applied to the steam boiler is described in this embodiment, the invention can be applied also to a hot water boiler and a heating medium boiler. In the embodiment, if exhaust gas is introduced to inside of the inner water tube row 7 instead of providing the burner 33, this boiler can function as a waste-heat boiler or an exhaust gas boiler.

If a difference between amounts of heat received at upper and lower positions of the water tubes 5 and 6 is reduced, the shape, the size, and the installation pitch of the fins can appropriately be changed. Although the water tubes 5 and 6 are respectively divided into four regions I1 to I4 and O1 to O4, and the projecting lengths and the installation pitches of the fins 14 to 17 are changed in the embodiment, the water tubes can be divided into two or three regions, or into five or more regions. The projecting lengths and/or the installation pitches of the fins 14 to 17 may be changed gradually, that is, continuously in the longitudinal direction of the water tubes 5 and 6.

Although the projections provided on the water tubes 5 and 6 are the fins 14 to 17 in the embodiment, the projections may be studs. The studs are formed into a columnar shape, a conical shape, a circular truncated shape, or a hemispherical shape, and the studs are fixed to the outer peripheral surface of each of the water tubes.

What is claimed is:

1. A boiler, comprising:

an upper header;

a lower header; and a heat-transfer tube that connects the upper header with the lower header, the heat-transfer tube being provided with projections such that a heat-transfer area per unit length of the heat-transfer tube is smaller in an upstream region than that in a downstream region of combustion gas, wherein either or both installation pitches between adjacent upper and lower projections and projecting lengths of the projections from the heat-transfer tube are arranged such that the heat-transfer area per unit length of the heat-transfer tube is smaller in the upstream region than that in the downstream region of the combustion gas, and wherein the projections are fins provided on the heat-transfer tube at distances from one another in the vertical direction, the boiler further comprises a plurality of inner heat-transfer tubes which are arranged cylindrically between the upper header and the lower header, and which constitute an inner heat-transfer tube row, a plurality of outer heat-transfer tubes which are arranged cylindrically between the upper header and the lower header to surround the inner heat-transfer tube row, and which constitute an outer heat-transfer tube row, a plurality of inner closing portions provided to close a gap between adjacent inner heat-transfer tubes while leaving a lower end of the inner heat-transfer tube row as it is, a plurality of outer closing portions provided to close a gap between adjacent outer heat-transfer tubes while leaving an upper end of the outer heat-transfer tube row as it is, inner fins which extend outward from the inner heat-transfer tubes, respectively, on a surface constituting an outer peripheral surface of the inner heat-transfer tube row, and which are inclined upward in a circumferential direction of the inner heat-transfer tube row, and outer fins which extend outward from the outer heat-transfer tubes, respectively, on a surface constituting an inner peripheral surface of the outer heat-transfer tube row, and which are inclined upward in a circumferential direction of the outer heat-transfer tube row, and wherein projecting lengths of the inner fins and the outer fins from the heat-transfer tubes in a lower region of each of the heat-transfer tubes are set smaller than those in an upper region of each of the heat-transfer tubes, and in a case where the projecting lengths are the same, the installation pitches are larger in the lower region than those in the upper region of each of the heat-transfer tubes.

2. The boiler according to claim 1, wherein the projecting lengths of the projections from the heat-transfer tube are set shorter in the upstream region than those in the downstream region of the combustion gas so as to reduce a difference of an amount of heat received per unit length of the heat-transfer tube that is created due to positions of the projections in a vertical direction of the heat-transfer tube, and in a case where the projecting lengths are the same, the installation pitches are larger in the upstream region than those in the downstream region of the combustion gas.

3. The boiler according to claim 2, Wherein the projections are fins provided on the heat-transfer tube at distances from one another in the vertical direction, the boiler further comprises a plurality of inner heat-transfer tubes which are arranged cylindrically between the upper header and the lower header, and which constitute an inner heat-transfer rube row, a plurality of outer heat-transfer tubes which are arranged cylindrically between the upper header and the lower header to surround the inner heat-transfer tube row, and which constitute an outer heat-transfer tube row, a plurality of inner closing portions provided to close a gap between adjacent inner heat-transfer tubes while leaving a lower end of the inner heat-transfer tube row as it is, a plurality of outer closing portions provided to close a gap between adjacent outer heat-transfer tubes while leaving an upper end of the outer heat-transfer tube row as it is, inner fins which extend outward from the inner heat-transfer tubes, respectively, on a surface constituting an outer peripheral surface of the inner heat-transfer tube row, and which are inclined upward in a circumferential direction of the inner heat-transfer tube row, and outer fins which extend outward from the outer heat-transfer tubes, respectively, on a surface constituting an inner peripheral surface of the outer heat-transfer tube row, and which are inclined upward in a circumferential direction of the outer heat-transfer tube row, and wherein projecting lengths of the inner fins and the outer fins from the heat-transfer tubes in a lower region of each of the heat-transfer tubes are set smaller than those in an upper region of each of the heat-transfer tubes, and in a case where the projecting lengths are the same, the installation pitches are larger in the lower region than those in the upper region of each of the heat-transfer tubes.

4. The boiler according to claim 3, wherein an installing region of the inner fin in the inner heat-transfer tube and an installing region of the outer tin in the outer heat-transfer tubes are each divided into a first region, a second region, a third region and a fourth region from bottom to top, projecting lengths of the inner fin and the outer fin in the first region and the second region are set smaller than those in the third region and the fourth region, and installation pitches of the inner fins and the outer fins in the first region and the third region are set larger than those in the second region and the fourth region.

5. The boiler according to claim 1, wherein an installing region of the inner fin in the inner heat-transfer tube and an installing region of the outer fin in the outer heat-transfer tubes are each divided into a first region, a second region, a third region and a fourth region from bottom to top, projecting lengths of the inner fin and the outer fin in the first region and the second region are set smaller than those in the third region and the fourth region, and installation pitches of the inner fins and the outer fins in the first region and the third region are set larger than those in the second region and the fourth region.

* * * * *

UNITED STATES PATENT AND TRADEMARK OFFICE

CERTIFICATE OF CORRECTION

PATENT NO. : 8,677,945 B2
APPLICATION NO. : 12/997362
DATED : March 25, 2014
INVENTOR(S) : Soji Sumi et al.

It is certified that error appears in the above-identified patent and that said Letters Patent is hereby corrected as shown below:

In the Claims:

At column 10, claim number 4, line number 51, please correct “outer tin” to --outer fin--.

Signed and Sealed this
First Day of March, 2016

Michelle K. Lee

Michelle K. Lee
*Director of the United States Patent and Trademark Office*